United States Patent [19]

Staebler et al.

[11] 4,011,030

[45] Mar. 8, 1977

[54] ENGINE SEAL ASSEMBLY

[75] Inventors: Paul J. Staebler, Dunlap; Ziedonis I. Krauja; Alexander Goloff, both of East Peoria, all of Ill.

[73] Assignee: Caterpillar Tractor Co., Peoria, Ill.

[22] Filed: Oct. 31, 1975

[21] Appl. No.: 627,569

[52] U.S. Cl. ..... 418/51; 418/142; 277/79; 277/138; 277/193

[51] Int. Cl.[2] ..... F01C 19/00; F01C 1/02; F16J 9/16; F16J 15/00

[58] Field of Search ..... 418/49–53, 418/142; 123/8.01; 277/78, 79, 138, 139, 141, 193

[56] References Cited

UNITED STATES PATENTS

| | | | |
|---|---|---|---|
| 1,288,085 | 12/1918 | McGinniss | 277/138 |
| 2,951,732 | 9/1960 | Brenneke | 277/79 |
| 3,153,540 | 10/1964 | Naperala et al. | 277/78 |
| 3,583,293 | 6/1971 | De Biasse | 277/193 |
| 3,759,148 | 9/1973 | Geffroy | 277/193 |
| 3,884,602 | 5/1975 | Phillips | 418/142 |

OTHER PUBLICATIONS

Clarke et al., *A New Class of Rotary Piston Machine Suitable for Compressors, Pumps, and Internal Combustion Engines*, Proceedings at Institute of Mechanical Engineers, 1972, vol. 186 62/72, pp. 743–753, 418–453.

*Primary Examiner*—John J. Vrablik
*Attorney, Agent, or Firm*—Wegner, Stellman, McCord, Wiles & Wood

[57] ABSTRACT

An improved internal combustion engine including a housing defining an operating chamber having a wall, an output shaft journalled in the housing and a piston operatively associated with the shaft and movable within the housing. The piston is provided with a seal receiving groove and the groove receives both a compression seal and an oil seal. In a preferred embodiment, the groove includes a step to define a relatively deep compression seal receiving portion and a relatively shallow oil seal receiving portion.

4 Claims, 4 Drawing Figures

ENGINE SEAL ASSEMBLY

BACKGROUND OF THE INVENTION

This invention relates to internal combustion engines.

In certain engines, such as a slant axis rotary engine, oil seals and compression seals play an important role in limiting the displacement of the engine. For example, in slant axis rotary engines, it is necessary that both such seals sealingly engage an inner spherical wall of an operating chamber at all times, thereby limiting the angle of wobble available. Engine displacement, and therefore, power output, are directly dependent upon the wobble angle.

Similarly, in trochoidal type engines, oil seals and gas seals play a role in limiting the displacement of the engine, although, to a lesser extent than in a slant axis rotary engine.

SUMMARY OF THE INVENTION

It is the principal object of the invention to provide a new and improved internal combustion engine. More specifically, it is an object of the invention to provide a new and improved oil and compression seal arrangement for use in internal combustion engines. Another object is the provision of such a seal configuration in a rotary engine to enhance displacement characteristics thereof.

An exemplary embodiment of the invention achieves the foregoing objects in an internal combustion engine including a housing defining an operating chamber having a wall and an output shaft journalled in the housing. A piston is operatively associated with the shaft and movable within the housing. The piston is provided with a seal receiving groove and both a compression seal and an oil seal are received in the groove in side-by-side substantial abutting relation.

As a consequence, in a slant axis rotary engine, a greater wobble angle is achievable to provide for greater displacement. In a trochoidal engine, increased displacement is achievable along with increased strength in that a larger gear and shaft may be employed.

When employed in reciprocating engines, the pistons may be made of a lesser top to bottom dimension, thereby reducing the height of the engine by the same amount.

According to a preferred embodiment of the invention, the groove includes a step to define a relatively deep compression seal receiving portion and a relatively shallow oil seal receiving portion. Consequently, the compression seal may be pushed against the ledge to provide the gas seal.

In a highly preferred embodiment of the foregoing, the step is slightly crowned to preclude jamming of the gas seal. Preferably, an oil drain conduit is in fluid communication with the oil seal receiving portion of the groove. In a highly preferred embodiment, the oil seal is a single rail seal and includes an integral spring biasing means.

While, as alluded to previously, the invention may be advantageously employed in various types of internal combustion engines, in its best mode, it will be employed in a slant axis rotary engine.

other objects and advantages will become apparent from the following specification taken in conjunction with the accompanying drawings.

DECRIPTION OF THE PREFERRED EMBODIMENTS

Figure 1:
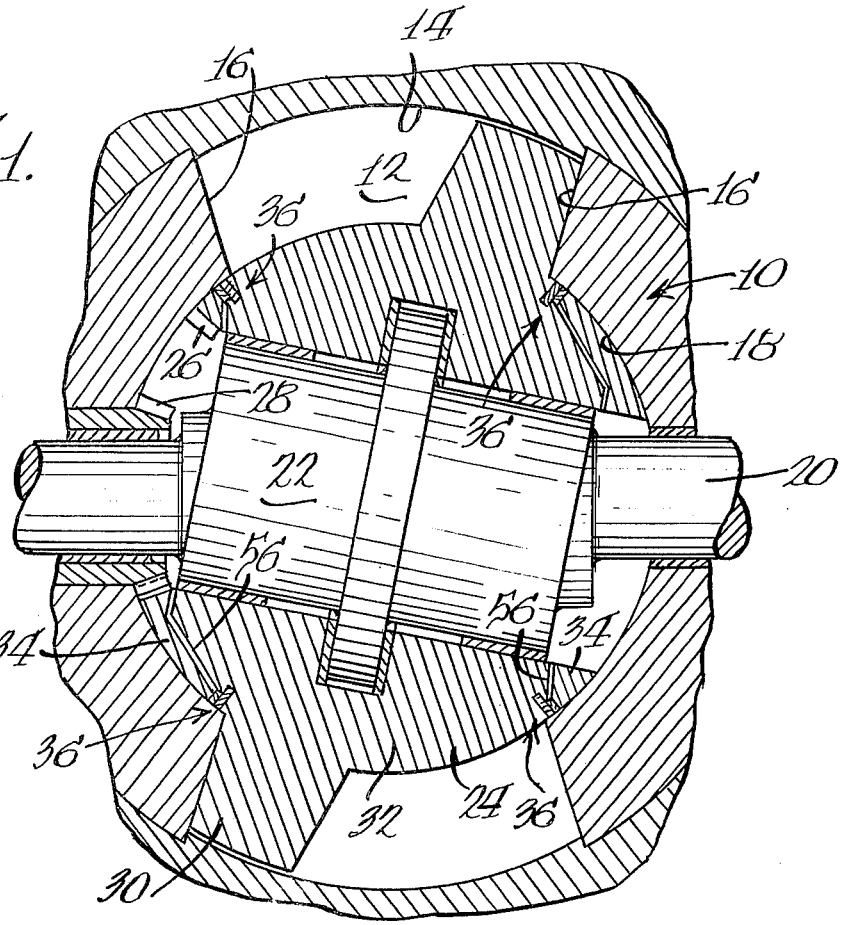
FIG. 1 is a sectional view of a slant axis rotary engine employing the invention.

An exemplary embodiment of an internal combustion engine made according to the invention is illustrated in FIG. 1 in the form of a slant axis rotary engine. The same includes a housing, generally designated 10, defining an operating chamber 12 bounded by an outer peripheral wall 14, spaced, generally radially extending side walls 16, and a spherical, radially inner, peripheral wall 18.

The housing 10 journals a shaft 20 having an angularly offset portion 22 which, in any conventional fashion, journals a rotor 24 for movement within the chamber 12. The rotor carries an internal ring gear formation 26 which is in engagement with a fixed gear 28 carried by the housing 10 so that proper relative movement between the shaft 20 and the rotor 24 is attained.

The rotor 24 includes a peripheral flange 30 which is provided with apex seals and peripheral seals (not shown) in a conventional fashion. The rotor 24 is also defined by a spherical hub 32 having ends 34 at each of which there is disposed a seal assembly, generally designated 36, and made according to the invention. As is well known, each seal assembly 36 will be generally circular in shape about the angularly offset portion 22 of the shaft 20.

Figure 2:
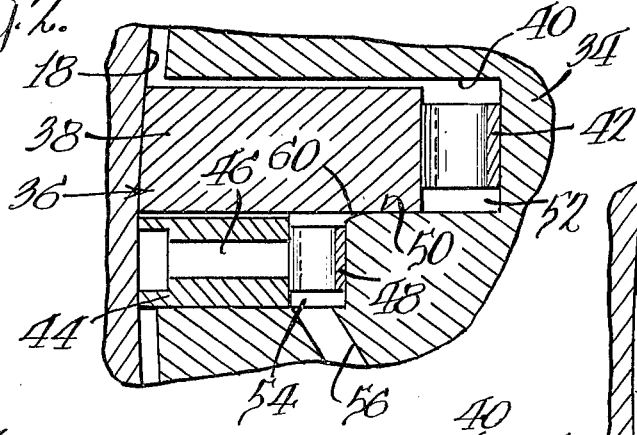
FIG. 2 is a fragmentary, enlarged view of a portion of FIG. 1.

Turning now to FIG. 2, each seal assembly 36 will be seen to be comprised of a compression seal 38 sealingly engaging the radially inner peripheral wall 18 of the chamber and located in a groove 40 near the hub end 34. Disposed behind the compression seal 38 is an undulating biasing spring 42 or the like.

Each seal assembly 36 further includes an oil seal 44 also enagement with the radially inner peripheral wall 18 and located in the groove 40 in substantial side-by-side abutting relation with the compression seal 38.

A biasing spring 48 for the oil seal 44 is provided.

According to the preferred embodiment of the invention, the groove 40 includes a step 50 to divide the same into a relatively deep compression seal receiving portion 52 and a relatively shallow oil seal receiving portion 54 receiving the compression seal 38 and the oil seal 44, respectively. In addition, the oil seal receiving portion 54 includes a drain conduit 56 from which oil entering the portion 54 may pass to the vicinity of the shaft 20. As illustrated in FIG. 2, the oil seal 44 is of the double rail type thereby providing for relatively free flow of the excess oil to the conduit 56.

In general, it is desirable that the width of the oil seal 44 be slightly less than the height of the step 50, as can be seen in FIG. 2. In addition, it is desirable that the step 50 be slightly crowned as illustrated at 60. As a consequence of the foregoing, when pressure is applied to the compression seal 38 during operation of the engine, the same will be slammed against the upper side of the step 50 to establish a seal against the escape of the hot gases of combustion. At the same time, the compression seal 38 will tip slightly in a counterclockwise direction, as shown in FIG. 2, until stopped by the oil seal, thereby establishing an equilibrium.

The crown portion 60 jamming of the compression seal 38 as a result of the above mentioned cocking movement.

Figure 3:
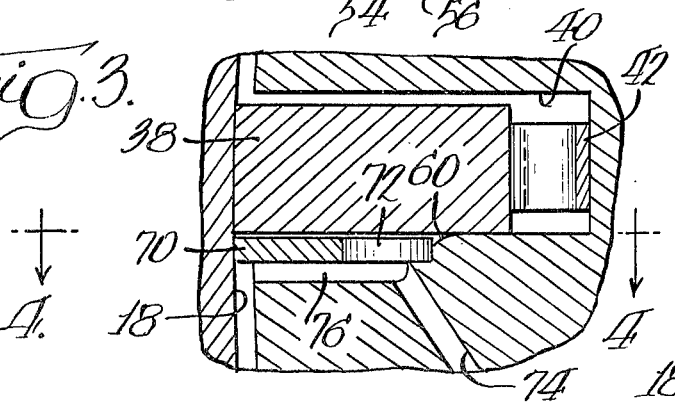
FIG. 3 is a fragmentary, enlarged sectional view of a modified embodiment of the invention.
Figure 4:
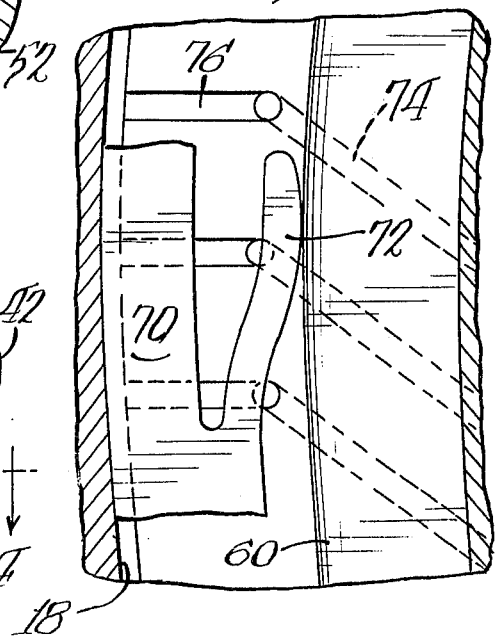
FIG. 4 is a sectional view taken approximately along the line 4—4 of FIG. 3.

A modified embodiment of the invention is illustrated in FIGS. 3 and 4 wherein a single rail oil seal 70 is employed. As seen in FIG. 4, at periodic intervals along the inner periphery of the oil seal 70, the same may be formed with resilient fingers 72 to serve as an integral baising spring in place of the spring 48. In addition, at periodic intervals along the length of the groove 40, oil drain conduits 74 opening into slot 76 adjacent the under side of the seal 70 may be advantageously employed. While not shown in FIGS. 3 or 4, it is contemplated that the groove 40 employed therein may also be stepped in a manner like that illustrated in FIGS. 1 and 2.

From the foregoing, it will be appreciated that an internal combustion engine made according to the invention possesses numerous advantages over those heretofore known. If the engine is a slant axis rotary engine, it is possible to increase the wobble angle to thereby increase displacement and power delivery. If the engine is a trochoidal engine, larger gearing and shafting may be employed to enhance engine strength and ruggedness. If the engine is a reciprocating engine, engine height may be minimized through the use of shorter pistons.

What is claimed is:

1. In an internal combustion engine, the combination comprising:

a housing defining an operating chamber having a wall;

an output shaft journalled in said housing;

a piston operatively associated with said shaft and movable within said housing;

a seal receiving groove on said piston, said groove including a step to define a relatively deep compression seal receiving portion and a relatively shallow oil seal receiving portion, said step being slightly crowned;

a compression seal received in said groove and sealingly engaging said wall; and an oil seal received in said groove in side-by-side, substantially abutting relation within said compression seal, the width of the oil seal being slightly less than the height of the oil seal receiving portion of the groove to permit cocking of the compression seal, the crowned step preventing jamming of the compression seal when cocked.

2. The internal combustion engine of claim 1 further including drain conduit means opening into said groove to the side of said oil seal opposite said compression seal.

3. The internal combustion engine of claim 2 wherein said drain conduit means includes plural slots opening into said groove.

4. In a rotary mechanism such as a pump, engine, compressor or the like, the combination of:

a housing defining an operating chamber having a wall;

an output shaft journalled in said housing;

a rotary piston journalled on said shaft and within said operating chamber;

a seal receiving groove on said piston, said groove including a step to define a relatively deep compression seal receiving portion and a relatively shallow oil seal receiving portion, said step being slightly crowned;

a compression seal received in said groove and sealingly engaging said wall; and an oil seal received in said groove in side-by-side substantially abutting relation within said compression seal, the width of the oil seal being slightly less than the height of the oil seal receiving portion of the groove to permit cocking of the compression seal, the crowned step preventing jamming of the compression seal when cocked.

* * * * *

UNITED STATES PATENT AND TRADEMARK OFFICE

CERTIFICATE OF CORRECTION

PATENT NO. : 4,011,030

DATED : March 8, 1977

INVENTOR(S) : Paul J. Staebler, Ziedonis I. Krauja and Alexander Goloff

It is certified that error appears in the above-identified patent and that said Letters Patent are hereby corrected as shown below:

Column 1, line 66, "other" should read --Other--.

Column 2, line 44, "36" should read --38--.

Column 2, line 45, "enagement" should read --in engagement--.

Column 3, line 4, after "60" insert --prevents--.

Signed and Sealed this

*second* Day of *August 1977*

[SEAL]

*Attest:*

RUTH C. MASON
*Attesting Officer*

C. MARSHALL DANN
*Commissioner of Patents and Trademarks*